United States Patent [19]

Kinney et al.

[11] 4,404,444

[45] Sep. 13, 1983

[54] CONVERTIBLE ALTERNATE ACTION/MOMENTARY PUSHBUTTON SWITCH

[75] Inventors: Dwayne R. Kinney, Minnetonka; Herman H. Sinn, Rockford, both of Minn.

[73] Assignee: Electronic Components Groupe, Inc., Minneapolis, Minn.

[21] Appl. No.: 345,620

[22] Filed: Feb. 4, 1982

[51] Int. Cl.[3] ..... H01H 13/56

[52] U.S. Cl. ..... 200/153 J; 200/328

[58] Field of Search ..... 200/153 J, 153 JH, 328

[56] References Cited

U.S. PATENT DOCUMENTS

| | | | |
|---|---|---|---|
| Re. 27,963 | 4/1974 | Schadow | 200/159 |
| 1,309,840 | 7/1919 | Bramming | 200/159 R |
| 1,323,822 | 12/1919 | Bramming | 200/51.13 |
| 2,671,354 | 3/1954 | Goos | 74/503 |
| 2,946,237 | 7/1960 | Hebert | 74/527 |
| 2,956,446 | 10/1960 | Ensign, Jr. et al. | 74/503 |
| 2,996,593 | 8/1961 | McMains | 200/159 |
| 3,229,548 | 1/1966 | De Rougemont et al. | 74/527 |
| 3,406,589 | 10/1968 | Gaber | 74/503 |
| 3,411,376 | 11/1968 | Weber et al. | 74/527 |
| 3,436,983 | 4/1969 | Krantz | 74/527 |
| 3,493,705 | 2/1970 | Noll et al. | 200/159 |
| 3,566,705 | 3/1971 | Frydman | 74/107 |
| 3,639,714 | 2/1972 | Fujimoto et al. | 200/153 |
| 3,722,313 | 3/1973 | Schadow | 74/483 |
| 3,867,596 | 2/1975 | Schadow | 200/328 X |
| 4,144,419 | 3/1979 | Schadow | 200/153 LA X |
| 4,218,598 | 8/1980 | Iwasaki et al. | 200/153 J |
| 4,360,721 | 11/1982 | Niinuma | 200/153 J |

FOREIGN PATENT DOCUMENTS

| | | | |
|---|---|---|---|
| 1915584 | 5/1965 | Fed. Rep. of Germany . | |
| 1233456 | 8/1967 | Fed. Rep. of Germany | 200/153 JH |
| 1260586 | 8/1968 | Fed. Rep. of Germany | 200/328 |
| 1295048 | 3/1969 | Fed. Rep. of Germany | 200/153 JH |
| 1250589 | 12/1959 | France | 200/153 JH |
| 1285260 | 11/1960 | France | 200/153 JH |
| 1367668 | 6/1963 | France | 200/153 JH |
| 2326773 | 9/1975 | France . | |
| 2373863 | 12/1976 | France . | |
| 43-12334 | 5/1968 | Japan . | |
| 43-23497 | 10/1968 | Japan | 200/153 JH |
| 50-26914 | 8/1975 | Japan . | |
| 958663 | 5/1964 | United Kingdom | 200/153 JH |
| 1164260 | 9/1969 | United Kingdom | 200/153 JH |
| 1494334 | 12/1977 | United Kingdom | 200/153 JH |
| 1503916 | 3/1978 | United Kingdom . | |

*Primary Examiner*—John W. Shepperd
*Assistant Examiner*—Renee S. Kidorf
*Attorney, Agent, or Firm*—Kinney, Lange, Braddock, Westman and Fairbairn

[57] ABSTRACT

A pushbutton switch capable of conversion from alternate action operation to momentary operation includes a housing, an elongated slider with a heart-shaped cam groove, a removable alternate action stop member, and a helical compression spring. The removable alternate action stop member is in the form of a rigid wire with an upturned pivot leg, a downturned detent leg parallel to the pivot leg and a crosspiece . The upturned pivot leg extends upward through a pivot hole in an upper tongue of the housing and the detent leg extends downward into the heart-shaped cam groove in the slider. A top opening in the housing communicates with the pivot hole and provides an area for side-to-side swinging movement of the crosspiece as the slider moves along a longitudinal axis and the lower end of the detent leg follows the heart-shaped cam groove. A raised cover connected to the upper tongue covers a portion of the top opening and protects the stop member from damage during assembly or use. The helical compression spring surrounds the slider and supplies an outward bias force to the slider. In addition, the helical compression spring has an end which surrounds at least a portion of the upper tongue and applies a longitudinal bias force to the upper end of the stop member which tends to bias the lower end of the detent leg into engagement with the heart-shaped groove.

17 Claims, 6 Drawing Figures

Fig.3
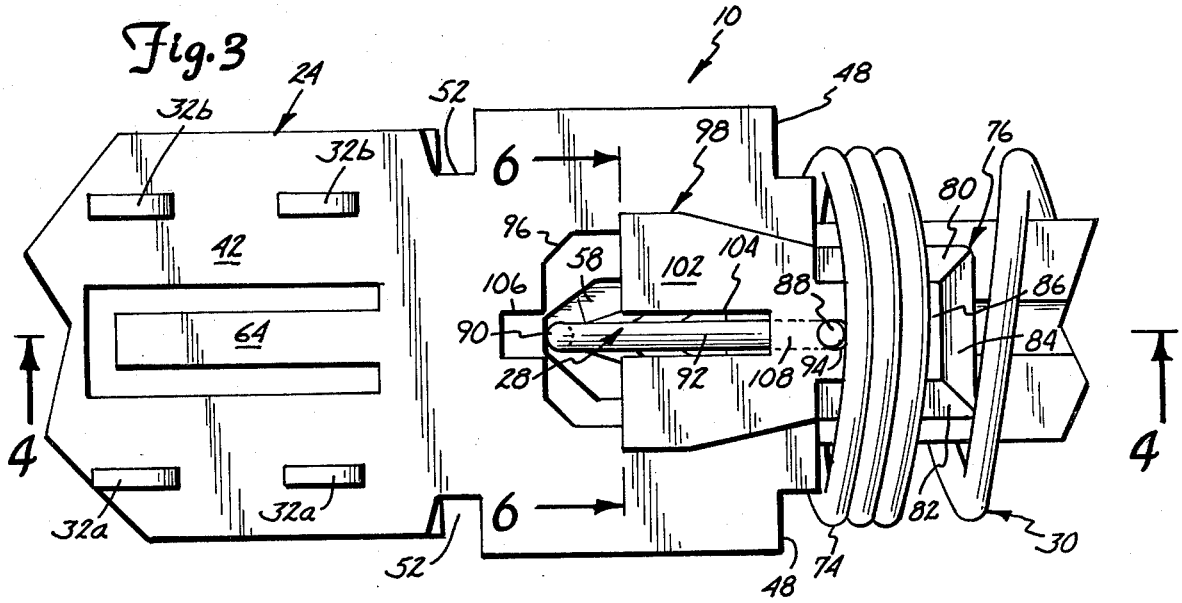
Fig.4
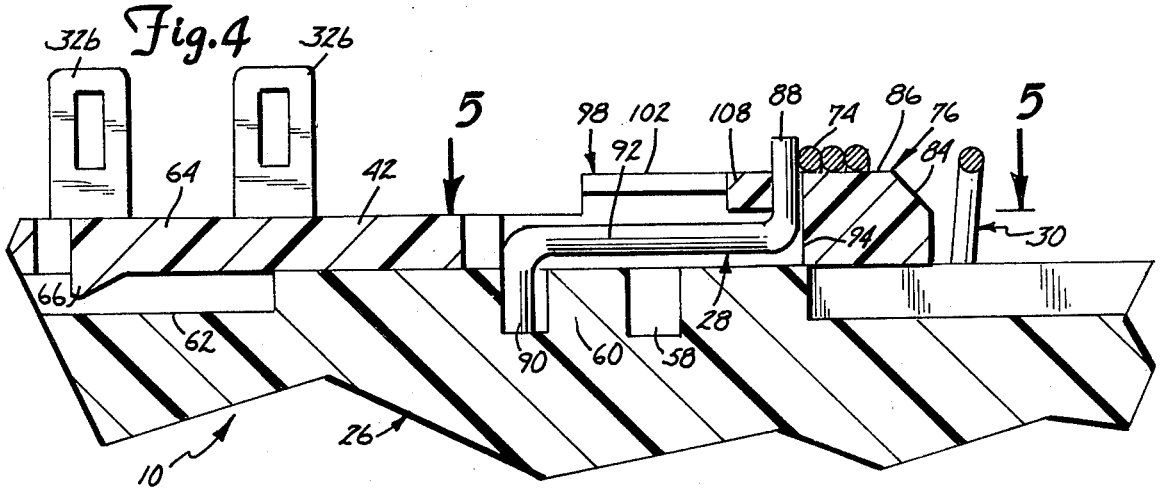
Fig.6
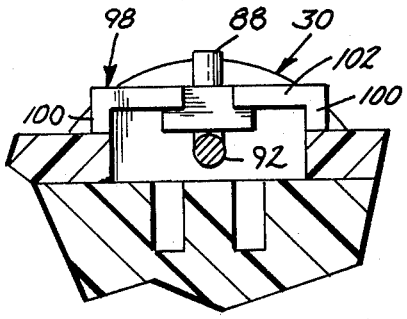
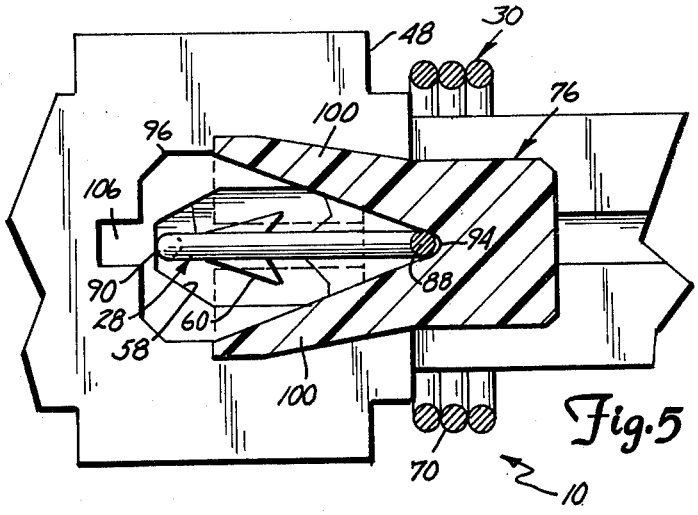
Fig.5

CONVERTIBLE ALTERNATE ACTION/MOMENTARY PUSHBUTTON SWITCH

BACKGROUND OF THE INVENTION

1. Field of the Invention

The present invention relates to pushbutton switch mechanisms. In particular, the present invention relates to a pushbutton switch mechanism which is capable of either momentary or alternate action operation by selective removal or insertion of a removable alternate action stop member.

2. Description of the Prior Art

There are various constructions of pushbutton switches known in the prior art. One typical type of pushbutton switch has a housing and an elongated slider or plunger which moves in a longitudinal axis within the housing. The slider normally carries a plurality of conductive contacts which are brought into engagement with terminals carried by the housing. The particular terminals which are connected by the conductive contacts depend upon the position of the slider with respect to the housing. The slider is normally biased outwardly from the housing by a helical compression return spring.

One type of pushbutton switch which has found wide use in the past is a miniature pushbutton switch which is usable with various types of electronic circuitry. These types of switches have found particularly wide use in radio and television receivers and test instrumentation.

There are three typical operating modes of miniature pushbutton switches. The first mode is referred to as "alternate action" or "push to make/push to break". In this operating mode, the slider has two stable switch positions. Depressing the pushbutton causes the slider to move from one stable position to the other.

The second typical operating mode is the "momentary" mode. In this mode of operation, the slider is biased by the helical return spring so that it always returns to the same position after force is released from the pushbutton head.

The third operating mode is the "interlocking" mode. In this mode, several momentary pushbutton switches are mounted side-by-side in a common chassis. A sliding interlock release bar moves in the chassis so that only one switch is depressed at any time. An example of this type of interlocking arrangement is shown in U.S. Pat. No. 3,722,313 by Schadow.

The typical arrangement for achieving alternate action operation of a miniature pushbutton switch includes a heart-shaped cam groove or surface and some form of pin, ball or detent which rides in the heart-shaped cam groove to position and stop the slider at one of the two stable positions defined by the heart-shaped cam groove. Various configurations of this basic arrangement have been used in the past, as shown by the following patents:

| | | |
|---|---|---|
| U.S. Pat. No. | Re.27,963 | Schadow |
| | 1,309,840 | Bramming |
| | 1,323,822 | Bramming |
| | 2,671,354 | Goos |
| | 2,946,237 | Hebert |
| | 2,956,446 | Ensign, Jr. et al |
| | 2,996,593 | McMains |
| | 3,229,548 | DeRougemont et al |
| | 3,406,589 | Gaber |
| | 3,411,376 | Weber et al |

-continued

| | | |
|---|---|---|
| | 3,436,983 | Krantz |
| | 3,493,705 | Noll et al |
| | 3,566,705 | Frydman |
| | 3,639,714 | Fujimoto et al |
| Japanese Utility Model | | 12,334/68 |
| Japanese Patent Application | | 43-23497 |
| Japanese Patent Application | | 50-26914 |
| French Patent | | 1,250,589 |
| French Patent | | 1,285,260 |
| French Patent | | 1,367,668 |
| French Patent | | 2,373,863 |
| French Patent | | 2,326,773 |
| United Kingdom Patent | | 958,663 |
| United Kingdom Patent | | 1,494,334 |
| United Kingdom Patent | | 1,503,916 |
| United Kingdom Patent | | 1,164,260 |
| German Patent | | 1,233,456 |
| German Patent | | 1,260,586 |
| German Patent | | 1,295,048 |
| German Gebrauschsmuster | | 1,915,584 |

In recent years, the configuration which has found widest use in miniature pushbutton switches is that shown in U.S. Reissue Patent No. 27,963 by Schadow. In this configuration, the stop member is in the form of a U-shaped pin. One leg of the pin is used as a detent and rides in the heart-shaped cam surface. The other leg is used as a pivot to allow the detent leg to move in a direction which is transverse to the movement of the slider so as to follow the shape of the cam surface. The U-shaped pin is positioned so that a portion of a helical return spring surrounds the U-shaped pin and engages the crosspiece of the pin to retain the pin in place. To convert the switch to momentary action, the helical spring is compressed and the U-shaped pin is lifted out. The helical spring can then be released, and the switch is capable of use either as a momentary switch, or as one of a group of switches in an interlocking configuration.

The arrangement shown in the Schadow Reissue Pat. No. 27,963 has the advantage of providing rapid conversion between alternate action and momentary operation, so that the manufacturer can use the same switch configuration and can convert existing inventories of momentary switches to alternate action switches or vice versa by the insertion or removal of the U-shaped pin. In addition, the use of the helical spring to surround and hold the U-shaped pin in place minimizes the number of parts needed to hold the U-shaped pin in position. In comparison, other configurations such as that shown in the DeRougemont Pat. No. 3,229,548 and in German Pat. No. 1,233,456 have required a separate retainer to hold the stop pin in place. This retainer is an unnecessary part which performs no function if the switch is used in a momentary mode of operation.

The configuration shown in the Schadow Reissue Pat. No. 27,963 does, however, have some shortcomings. In particular, the proper operation of the switch is dependent upon the orientation of the helical spring. If the end of the helical spring abuts the side of the cross member of the U-shaped pin, it can limit the side-to-side swinging movement of the U-shaped pin and cause failure of operation of the switch. Care must be taken, therefore, to ensure that the end of the helical spring does not contact the side of the U-shaped pin.

In addition, the configuration shown in the Schadow Reissue Pat. No. 27,963 exposes a substantial portion of the U-shaped pin, since most of the pin is located above the top surface of the cover (or "terminal board") of the switch housing. Thus the U-shaped pin can be damaged during manufacture of the switch itself, or during construction of a switch assembly in a chassis by the customer.

There is a continuing need for an improved pushbutton switch which is capable of rapid and simple conversion between an alternate action mode of operation and a momentary or interlocking mode of operation. In particular, there is a need for a pushbutton switch configuration which differs from and avoids the shortcomings of the configuration shown in the Schadow Reissue Pat. No. 27,973, yet utilizes a minimum amount of parts to provide the alternate action operation.

SUMMARY OF THE INVENTION

The present invention is an improved pushbutton switch mechanism which is selectively capable of either momentary or alternate action operation. The pushbutton switch mechanism includes a housing, an elongated slider, a removable alternate action stop member, and a helical compression spring. The housing of the pushbutton switch mechanism of the present invention includes first and second generally parallel side walls, a bottom, and a top which define a longitudinal slider cavity which is open at a first end of the housing, and which defines a longitudinal axis of movement of the slider. The housing includes a lower tongue portion which extends outward from the first end of the housing. The top of the housing includes an upper tongue which extends outward from the first end and is generally parallel to and spaced above the lower tongue. The upper tongue carries a vertical pivot hole which extends through the upper tongue. The top also includes a longitudinally extending top opening which communicates with the slider cavity and which is connected at one end to the pivot hole. The top also includes a raised cover portion which is connected to the upper tongue and which covers a portion of the top opening to protect the alternate action stop member.

The elongated slider extends between the upper and lower tongues of the housing and extends into the longitudinal slider cavity. The slider has an outer portion which is located outside the cavity and an inner portion which is located within the cavity. The outer portion of the slider has a shoulder which is normally longitudinally spaced from the first end of the housing. The inner portion of the slider has a heart-shaped cam groove in its upper surface which defines a pair of rest positions of the slider. The heart-shaped cam groove is located on the upper surface of the inner surface of the slider so that at least a portion of the heart-shaped cam is normally positioned below the top opening.

The removable alternate action stop member has an upturned pivot leg, a downturned detent leg which is parallel to the pivot leg, and a crosspiece which extends between the pivot leg and the detent leg to rigidly connect the pivot leg and the detent leg. When the stop member is in its normal operating position for alternate action operation of the pushbutton switch mechanism, the pivot leg extends upward through the vertical pivot hole so that an upper end of the pivot leg is above the upper tongue. The detent leg extends downward so that a lower end of the pivot leg extends into and cooperates with the heart-shaped cam groove. The crosspiece is movable in a side-to-side arc in the top opening. This side-to-side movement of the crosspiece occurs as the slider moves along the longitudinal axis and the lower end of the detent leg follows the heart-shaped cam groove.

The helical compression spring surrounds the slider and extends between the shoulder on the slider and the first end of the housing. The helical compression spring provides a longitudinal slider bias force which tends to bias the slider outward. In addition, the helical compression spring has a first end which surrounds at least a portion of the upper and lower tongues and which abuts the upper end of the pivot leg. As a result of this contact between the first end of the helical compression spring and the upper end of the pivot leg, the helical compression spring applies a generally longitudinal stop member bias force which tends to bias the lower end of the detent leg of the stop member into engagement with the heart-shaped cam groove.

The removable alternate action stop member is easily removable by applying a downward force on the upper end of the pivot leg. This causes the detent leg to be lifted out of engagement with the heart-shaped cam groove, and allows the detent leg end of the elongated slider to be lifted upward out of the top opening. This tipping and lifting of the detent leg end of the stop member causes the pivot leg to be pulled downward out of the pivot hole.

BRIEF DESCRIPTION OF THE DRAWINGS

FIG. 3 is a top view of a portion of the pushbutton switch mechanism of FIG. 1.

FIG. 4 is a sectional view of the pushbutton switch mechanism taken along line 4—4 of FIG. 3.

FIG. 5 is a sectional view of the pushbutton switch mechanism taken along line 5—5 of FIG. 4.

FIG. 6 is a sectional view of the pushbutton switch mechanism taken along line 6—6 of FIG. 3.

DETAILED DESCRIPTION OF THE PREFERRED EMBODIMENTS

Figure 1:
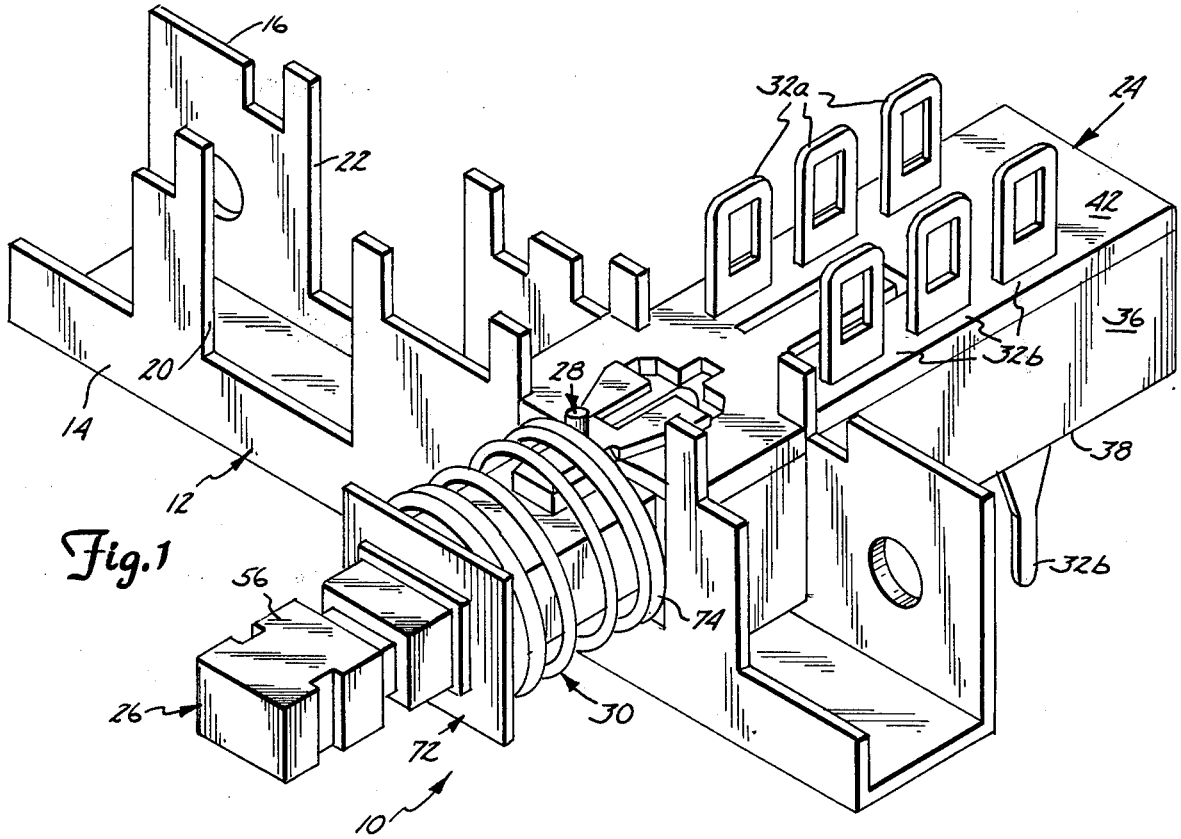
FIG. 1 is a perspective view of a pushbutton switch mechanism of the present invention mounted in a multiple switch chassis.

FIG. 1 shows pushbutton switch mechanism 10 of the present invention mounted in multiple switch bracket or chassis 12. Chassis 12 has a U-shaped channel configuration formed by front wall 14, back wall 16, and bottom 18. Walls 14 and 16 have a plurality of mutually aligned U-shaped mounting openings defined by edges 20 and 22. Each pair of mounting openings is capable of receiving and holding a pushbutton switch like switch 10 in the manner illustrated in FIG. 1.

Figure 2:
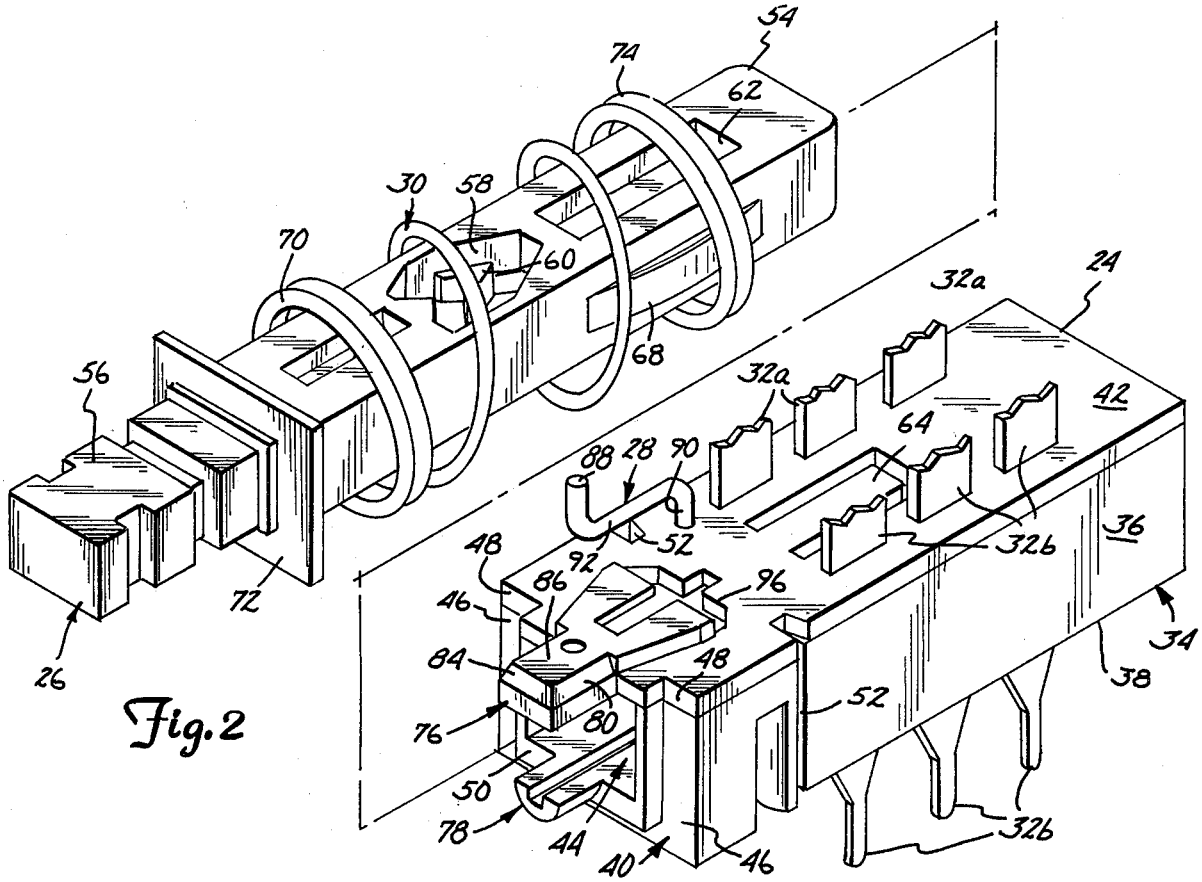
FIG. 2 is an exploded perspective view of the pushbutton switch mechanism of FIG. 1.

Switch 10 includes housing 24, elongated slider or plunger 26, removable alternate action stop member 28, helical compression spring 30 and two sets of electrically conductive terminals **32*a* and 32*b*. The particular embodiment of switch 10 illustrated in FIGS. 1 and 2 is a two-pole, double-throw configuration, and each set of terminals 32*a* and 32*b* include three metallic terminals. The number of terminals in each set 32*a* and 32*b*** depends upon the number of poles of the switch (e.g. a four-pole double-throw switch typically has six terminals in each set and a six-pole double-throw switch typically has nine terminals in each set). The number or arrangement of terminals is not critical to the present invention, and therefore the two-pole double-throw configuration shown in the Figures is merely one example.

Housing 24 includes a box-like base 34 having a pair of generally parallel side walls 36, bottom 38 and front end 40. Housing 24 also includes a generally flat top 42, which is typically referred to as a "terminal board". Base 34 and top 42 are preferably molded electrically insulating synthetic polymer material and are assembled by conventional means such as glue or snap type connectors. As best shown in FIG. 2, housing 24 defines an internal elongated cavity or chamber 44 which is open at front end 40 to receive slider 26 and permit longitudinal movement of a portion of slider 26 within cavity 44.

To facilitate mounting of switch 10 in chassis 12, front end 40 of base 34 has recessed edges 46 along both sides and its bottom, and top 42 has similar recessed edges 48. Recessed edges 46 and 48 cause housing 24 to have an outward projecting shoulder area 50 surrounding the entrance to cavity 44 which cooperates with edge 20 of chassis 12 to hold switch 10 in position. Vertical grooves 52 in each side of housing 24 are spaced rearwardly from recessed edges 46 and 48. Vertical grooves 52 cooperate with edges 22 of chassis 12 to position and hold switch 10 in chassis 12.

Slider 26 has one end 54 slidably located in cavity 44 of housing 24, and an opposite end 56 outwardly extended from housing 24 and cavity 44. End 56 is configured to accept a standard pushbutton cap or indicator button (not shown).

Slider 26 has a heart-shaped cam notch or groove 58 in its top surface, and a central boss 60. Groove 58 is located on a portion of the upper surface of slider 26 which is normally within housing 24 and is used as a detent engaging surface for defining alternate action operation of switch 10. Groove 58 preferably has inclined surfaces and steps to ensure that alternate action stop member 28 moves unidirectionally around the contour defined by groove 58 in a counterclockwise direction.

Slider 26 also has a longitudinal linear catch groove 62 in its top surface. Catch groove 62 cooperates with resilient cam arm 64, which is formed as an integral part of top 42. A downward cam projection 66 of cam arm 64 (best shown in FIG. 4) extends into groove 62 when slider 26 is in its normal position within housing 24. The outward movement of slider 26 is limited by projection 66 and groove 62 when alternate action stop member 28 is not being used and switch 10 is in a momentary action mode.

As shown in FIGS. 1 and 2, terminals 32*a* and 32*b* extend vertically through housing 24 on opposite sides of housing 24. Terminals 32*a* and 32*b* are positioned adjacent side walls 36 and are spaced apart so that slider 26 can move between terminals 32*a* and 32*b*. Terminals 32*a* and 32*b* have contact portions which are exposed to cavity 44. Slider 26 carries electrical bridging contacts 68 on each of its side walls. Bridging contacts 68 engage and connect selected pairs of terminals 32*a* and selected pairs of terminals 32*b*, depending upon the position of slider 26 with respect to housing 24.

Helical return spring 30 circumferentially surrounds a portion of outer end 56 of slider 26. End 70 of spring 30 bears against shoulder 72 of slider 26, while end 74 of spring 30 bears against front shoulder 50 of housing 24. Helical compression spring 30, therefore, applies an outward bias force to slider 26.

End 74 of helical compression spring 30 surrounds and is centered by upper tongue 76 and lower tongue 78. Upper tongue 76 is preferably an integral part of top 42, and has a thickness which is approximately twice the thickness of other portions of top 42. Upper tongue 76 preferably includes chamfered upper side surfaces 80 and 82 and chamfered upper end surface 84, as best shown in FIGS. 2 through 4. Lower tongue 78 is preferably an integral part of base 34, and extends outward from shoulder area 50. Lower tongue 78 has a generally semicircular cross section. Upper and lower tongues 76 and 78 are spaced apart so that the distance from top surface 86 of tongue 76 to the lower surface of lower tongue 78 is approximately equal to the inner diameter of helical spring 30. Thus end 74 of spring 30 is centered and held in place so that significant transverse movement of spring 30 does not occur.

Alternate action operation of switch 10 is provided by the interaction of alternate action stop member 28 with cam groove 58. The present invention is an improved configuration of stop member 28 and accompanying portions of housing 24 so that reliable alternate action operation of switch 10 is provided, and simple conversion of switch 10 from alternate action to momentary mode or vice versa is permitted without any wasted extra parts. The details of the present invention are more fully illustrated in FIGS. 3 through 6.

Alternate action stop member 28 of the present invention is a metal pin of circular cross-section having an upturned pivot leg 88, a downturned detent leg 90, and a crosspiece 92 which extends between and rigidly connects pivot leg 88 and detent leg 90. In a preferred embodiment of the present invention, stop member 26 is a tumble-polished pre-tinned steel pin having a diameter of about 0.75 mm, with pivot leg 88 having a length of about 2 mm, detent leg 90 having a length of about 2 mm, and crosspiece 92 having a length of about 3.5 mm.

Pivot leg 88 extends upward through pivot hole 94 in upper tongue 76. Pivot hole 94 is positioned on upper tongue 76 so that when the upper end of pivot leg 88 is above upper surface 86 of upper tongue 76, end 74 of helical compression spring 30 engages and pushes against pivot leg 88. In the preferred embodiments of the present invention, pivot hole 94 has a diameter which is slightly larger than the diameter of pivot leg 88, so that the longitudinal bias appplied by end 74 of spring 30 causes a tipping of the upper end of pivot leg 88. This bias force applied by spring 74 to pivot leg 88 is transferred by crosspiece 92 to a downward bias force on detent leg 90. As best shown in FIG. 4, detent leg 90 projects downward and cooperates with heart-shaped cam groove 58. As longitudinal movement of slider 26 occurs due to force applied to end 56 by a user, detent leg 90 follows heart-shaped cam groove 58 in a counterclockwise direction. Pivot hole 94 (together with the force applied by spring 30) retains pivot leg 88 in a generally fixed location, so that detent leg 90 and crosspiece 92 swing from side-to-side in an arc about an axis generally defined by pivot hole 94 as detent leg 90 follows cam groove 58.

To accommodate the side-to-side movement of crosspiece 92 and detent leg 90, and to provide access of detent leg 90 to cam groove 58, top 42 has a generally spade-shaped top opening 96. The widest portion of top opening 96 is the portion nearest detent leg 90, while the narrowest portion underlies upper tongue 76 and is connected to pivot hole 94.

In the preferred embodiment of the present invention shown in FIGS. 1–6, top opening 96 is partially covered by a raised top cover 98, which is an integral part of top 42 and which is attached to upper tongue 76. As best shown in FIG. 6, top cover 98 includes a pair of upstanding side walls 100 and a roof 102. Roof 102 is connected to and essentially coplanar with top surface 86 of upper tongue 76.

Top cover 98 provides protection of stop member 28. In the prior art, exposed U-shaped pins used as stop members can be damaged during manufacture of the switch itself, or during construction of the switch assembly in a chassis by the customer. Top cover 98 provides protection for stop member 28, without interferring with the operation of stop member 28 or the insertion and removal of stop member 28.

To facilitate easy insertion and removal of stop member 28, a longitudinal slot 104 is provided in roof 102 of top cover 98. Longitudinal slot 104 extends from the exposed end of top opening 98 toward pivot hole 94. In addition, top opening 98 includes relief area 106 which is longitudinally aligned with pivot hole 94, longitudinal slot 104, and the outermost end of heart-shaped cam groove 58.

Removal of stop member 28 to convert switch 10 from alternate action to momentary mode is achieved by applying force to the upper end of pivot leg 88 so as to lift detent leg 98 out of engagement with cam groove 58. Once detent leg 90 has been raised far enough so that it can be grasped (normally by pliers or tweezers or the like), it is pivoted and pulled upward which pulls pivot leg 88 downward out of the bottom of pivot hole 94. Longitudinal slot 104 and relief area 106 provide the necessary clearance so that stop member 28 can be lifted out of its operating position without interference from top cover 98 or top 42.

The reinsertion of stop member 28 to convert switch 10 from momentary to alternate action mode is generally a reverse procedure. The end of longitudinal slot 104 is spaced closely to pivot hole 94, so that pivot leg 88 can be inserted under top cover 98 and into the bottom end of pivot hole 94. Detent leg 90 is then swung downward into groove 58.

The lengths of pivot leg 88 and detent leg 90 are interrelated to the diameter of pivot hole 90, the thickness of upper tongue 76, and the thickness of portion 108 of top cover 98 located between the end of longitudinal slot 104 and pivot hole 90. In particular, pivot leg 88 and detent leg 90 must be long enough so that pivot leg 88 extends above top surface 86 of upper tongue 76 while detent leg 90 is in cam groove 58. On the other hand, pivot leg 88 must not be so long that it prevents downward removal from or upward insertion through pivot hole 94. To enhance the ability to insert or remove pivot leg 88, pivot hole 94 preferably has a diameter which is somewhat greater than the diameter of pivot leg 88, and portion 108 of top cover 98 between slot 104 and pivot hole 94 has a thickness which is one-half or less of the length of the length of pivot leg 88.

In one preferred embodiment of the present invention, upper tongue 76 has a width of 4.0 millimeters and a thickness of 2.0 millimeters. Chamfer surfaces 80, 82 and 84 have a 45° chamfer angle. Pivot hole 94 has a diameter of 1.0 millimeters. The center of pivot hole 94 is positioned in upper tongue 76 at a distance 3.0 millimeters from the outer end of upper tongue 76. A distance of 1.5 millimeters separates the end of longitudinal slot 104 from the center of pivot hole 94. The thickness of portion 108 of top cover 98 between the end of longitudinal slot 104 and pivot hole 94 is 1.0 millimeters, and the thickness of the portion of roof 102 overlying top opening 96 is 0.5 millimeters. The width of longitudinal slot 104 is 1.0 millimeters and its length is 3.4 millimeters. Top opening 96 has a width of 4.2 millimeters at its widest point, and top cover 98 has a width of 5.2 millimeters at its widest point. Relief area 106 has a width of 1.0 millimeters and a length of 1.0 millimeters.

In addition to its easy conversion from alternate action to momentary mode and its minimum number of parts needed to achieve these two modes of operation, switch 10 of the present invention has still further advantages. In particular, because helical spring 30 only abuts the upper end of pivot leg 88, proper operation of switch 10 does not depend upon the orientation of the helical compression spring 30. In particular, even if the end of helical spring 30 is in contact with upper leg 88, it does not limit side-to-side swinging movement of detent leg 90. This is unlike the U-shaped pin configuration shown in the Schadow Reissue Pat. No. 27,963, in which failure of operation in the alternate action mode can occur if the end of the helical spring abuts the side of the U-shaped pin. The present invention, therefore, does not require any special assembly step or inspection to ensure a particular orientation of helical spring 30.

Another important advantage of the present invention over prior art alternate action switches is that the entire structure used to hold stop member 28 in position for alternate action operation is an integral molded part of top 42. As a result, a minimum number of parts are required to be assembled with switch 10 of the present invention.

In conclusion, the present invention is an improved pushbutton switch mechanism capable of either alternate action or momentary modes of operation, and which can be rapidly and simply converted from one mode to the other. The present invention provides protection for the stop member during manufacture of the switch and assembly of switches in a chassis by the customer, while still permitting easy insertion and removal of the stop member.

Although the present invention has been described with reference to preferred embodiments, workers skilled in the art will recognize that changes may be made in form and detail without departing from the spirit and scope of the invention.

What is claimed is:

1. A pushbutton switch mechanism selectively capable of either momentary or alternate-action operation, the pushbutton switch mechanism comprising:

a housing including first and second generally parallel side walls, a bottom, and a top which define a longitudinal slider cavity which is open at a first end of the housing; the housing further including a lower tongue portion which extends outward from the first end; the top including an upper tongue which extends outward from the first end, which is generally parallel to and is spaced above the lower tongue, and which carries a vertical pivot hole which extends through the upper tongue; the top cover further including a longitudinally extending top opening which communicates with the cavity and which is connected to the pivot hole; and the top further including a raised cover connected to the upper tongue and covering a portion of the top opening;

an elongated slider adapted for actuating a switch, the slider extending between the upper and lower tongues and into the longitudinal slider cavity and being slidable along a longitudinal axis defined by the longitudinal slider cavity, the slider having an outer portion located outside the cavity and having an inner portion located within the cavity; the outer portion of the slider having a shoulder which is normally longitudinally spaced from the first end of the housing; inner portion of the slider having a heart-shaped cam groove in an upper surface of the slider which defines a pair of rest positions of the slider, the heart-shaped cam groove being located on the upper surface of the inner portion of the slider so that at least a portion of the heart-shaped cam groove is normally positioned below the top opening;

a removable alternate-action stop member having an upturned pivot leg, a downturned detent leg parallel to the pivot leg, and a crosspiece extending between and connecting the pivot leg and the detent leg; wherein the stop member is positioned with the pivot leg extending upward through the vertical pivot hole so that an upper end of the pivot leg is above the upper tongue and so that the stop member is permitted to pivot about a vertical pivot axis defined by the pivot hole, with the detent leg extending downward so that a lower end of the pivot leg extends into and cooperates with the heart-shaped cam groove, and with the crosspiece movable in a side-to-side arc in the top opening as the slider moves along the longitudinal axis and the lower end of the detent leg follows the heart-shaped cam groove; and wherein the stop member is selectively removable to permit momentary operation of the pushbutton switch mechanism; and a helical compression spring surrounding the slider and extending between the shoulder on the slider and the first end of the housing to provide a longitudinal slider bias force tending to bias the slider outward, the helical compression spring having a first end which surrounds at least a portion of the upper and lower tongues and which abuts the upper end of the pivot leg to apply a generally longitudinal stop member bias force tending to bias the lower end of the detent leg of the stop member into engagement with the heart-shaped cam groove.

2. The pushbutton switch mechanism of claim 1 wherein a raised cover extends from the upper tongue and covers a portion of the top opening, while allowing a portion of the top opening overlying the detent leg to be exposed.

3. The pushbutton switch mechanism of claim 2 wherein the raised cover includes a longitudinal slot which extends from the exposed portion of the top opening toward the pivot hole, and which is parallel to the longitudinal axis and is aligned with the pivot hole.

4. The pushbutton switch mechanism of claim 3 wherein the top opening includes a relief area aligned with the pivot hole and the longitudinal slot.

5. The pushbutton switch mechanism of claim 3, wherein the raised cover has a portion between the pivot hole and the end of the longitudinal slot closest to the pivot hole which has a thickness less than about half the length of the pivot leg.

6. The pushbutton switch mechanism of claim 1 wherein the upper tongue has a top surface essentially coplanar with a top surface of the raised cover.

7. The pushbutton switch mechanism of claim 6 wherein the upper tongue has sloped side surfaces.

8. The pushbutton switch mechanism of claim 7 wherein the upper tongue has a sloped outer end surface.

9. The pushbutton switch mechanism of claim 8 wherein the lower tongue has a curved lower surface, and wherein the upper and lower tongues engage and center the first end of the helical compression spring.

10. The pushbutton switch mechanism of claim 1 wherein the crosspiece of the removable alternate action stop member is essentially perpendicular to the pivot leg and essentially perpendicular to the detent leg.

11. The pushbutton switch mechanism of claim 10 wherein the removable alternate action stop member is a metal pin of circular cross section.

12. The pushbutton switch mechanism of claim 11 wherein the removable alternate action stop member is a tumble-polished pre-tinned steel pin.

13. The pushbutton switch mechanism of claim 11 wherein the removable alternate action stop member has a diameter of about 0.7 millimeters, the pivot leg has a length of about 2 millimeters, the detent leg has a length of about 2 millimeters, and the crosspiece has a length of about 3.5 milliameters.

14. The pushbutton switch mechanism of claim 1, claim 9 or claim 10 wherein the pivot hole has a diameter which is greater than the pivot leg.

15. The pushbutton switch mechanism of claim 14, wherein the pivot hole has a diameter of about 1.0 millimeters and the pivot leg has a diameter of about 0.75 millimeters.

16. The pushbutton switch mechanism of claim 1, wherein the top, the upper tongue, and the raised cover are an integral electrically insulating molded polymer element.

17. The pushbutton switch mechanism of claim 16, wherein the first and second generally parallel side walls, the bottom, and the lower tongue of the housing are an integral electrically insulating molded polymer element.

* * * * *